US005446345A

United States Patent [19]

Halabi et al.

[11] Patent Number: 5,446,345

[45] Date of Patent: Aug. 29, 1995

[54] MINIATURE PORTABLE FLASHER LIGHT

[75] Inventors: Wade Halabi, New Haven, Conn.; Kai K. Ho, Hong Kong, Hong Kong

[73] Assignee: Visibility Systems Connecticut Limited Partnership, New Haven, Conn.

[21] Appl. No.: 135,928

[22] Filed: Oct. 13, 1993

[51] Int. Cl.[6] ..... H05B 37/00

[52] U.S. Cl. ..... 315/200 A; 315/200 R; 315/241 S; 340/321

[58] Field of Search ..... 315/206, 209 R, 200 R, 315/200 A, 241 R, 241 S; 340/321, 331, 114 R

[56] References Cited

U.S. PATENT DOCUMENTS

| | | | |
|---|---|---|---|
| 2,923,069 | 2/1960 | Nachem | 35/14 |
| 3,061,719 | 10/1962 | Shattuck | 325/166 |
| 3,153,745 | 10/1964 | Gurian et al. | 315/206 |
| 3,205,487 | 9/1965 | Vriend | 340/321 |
| 3,631,318 | 12/1971 | Hubbard | 315/209 |
| 3,668,684 | 6/1972 | Johnson et al. | 340/321 |
| 4,047,150 | 9/1977 | Kelley | 340/84 |
| 4,124,842 | 11/1978 | Bachelor | 340/321 |
| 4,227,174 | 10/1980 | Belcher et al. | 340/81 |
| 4,383,244 | 5/1983 | Knauff | 340/321 |
| 4,408,182 | 10/1983 | Hashimoto et al. | 340/321 |
| 4,455,548 | 6/1984 | Burnett | 340/293 |
| 4,477,796 | 10/1984 | Kearsley | 340/105 |
| 4,595,978 | 6/1986 | Sheffield | 364/141 |
| 4,613,847 | 9/1986 | Scolari et al. | 315/200 A X |
| 4,654,629 | 3/1987 | Bezos et al. | 340/87 |
| 4,673,928 | 6/1987 | Gium | 340/638 |
| 4,684,852 | 8/1987 | Balogh | 315/241 |
| 4,827,245 | 5/1989 | Lipman | 340/321 |
| 4,893,111 | 1/1990 | Roller | 315/200 A X |
| 4,904,998 | 2/1990 | Niimi | 340/908.1 |
| 5,164,636 | 11/1992 | Allaire | 315/200 A |

*Primary Examiner*—Robert J. Pascal
*Assistant Examiner*—Haissa Philogene
*Attorney, Agent, or Firm*—Perman & Green

[57] ABSTRACT

A portable flasher device is disclosed in which a pair of body members are connected together to form a housing which has bi-directional planar dimensions and an axial dimension, the planar dimensions being substantially larger than the axial dimensions to give the housing a substantially greater planar extent that the axial extent, and the bi-directional dimensions being such as to define a peripheral extent of the housing to make it suitable for holding the flasher device comfortably within the average human hand. The device includes a pair of battery compartments arranged at an angle to each other to define a space therebetween, with a circuit board and other operating components arranged within the space so as to reduce the thickness of the device to a minimum. A reflector and flasher lamp are mounted within a clear housing over the circuit board. The device is provided with a means for strapping it to a user's wrist or arm, or mounting it on a standard photographic tripod. The flasher device can be part of a flasher kit which includes a variety of accessories mountable on the flasher body. The flasher device also includes an electronic control circuitry.

27 Claims, 7 Drawing Sheets

FIG. 12.
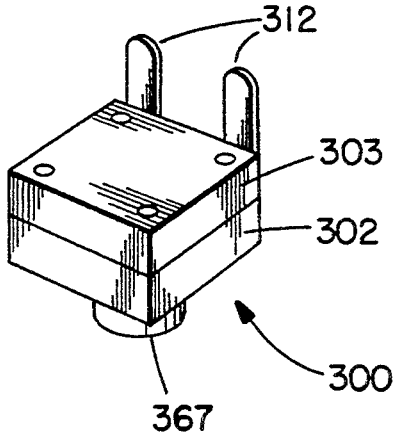
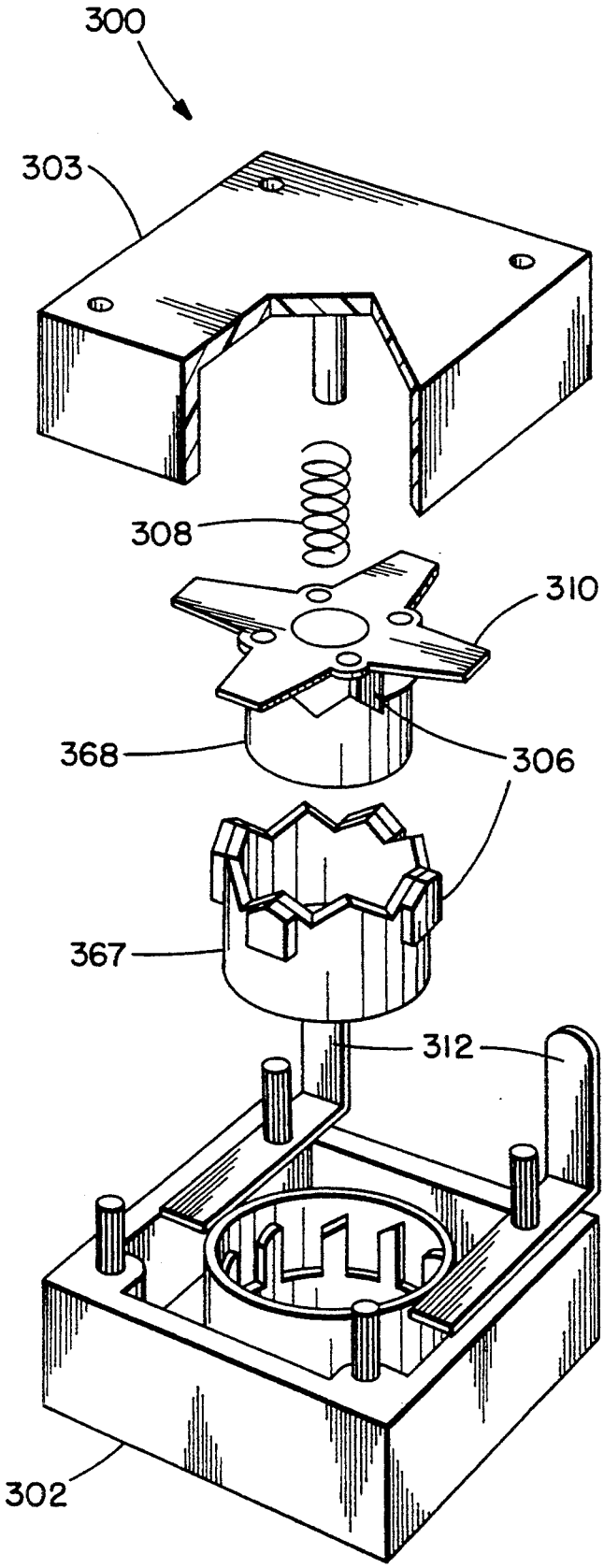
FIG. 13.

MINIATURE PORTABLE FLASHER LIGHT

BACKGROUND OF THE INVENTION

The present invention relates generally to the field of electronic flasher devices, and more particularly to an electronic flasher device which is sufficiently compact to fit comfortably within an average adult human hand or the pocket of clothing, or which can be worn on a wrist or mounted on a suitable support.

It has long been well known that portable flashing devices are very effective in the dark for warning observers of some characteristic of danger, or other condition which requires close attention by the observer. An all inclusive list of the types of situations in which flashing devices are used is far beyond the scope of this specification, but a few to which the present invention are related were worthy of mention.

Cyclists who ride at night are particularly vulnerable to vehicular hazards since they are not readily visible to rapidly approaching drivers, either because they have no bicycle lights or because the relatively simple flashlight type lights typically utilized by cyclists either do not attract attention or blend in with other surrounding lights.

Pedestrians who walk at night are similarly vulnerable, especially when walking in the roadway, crossing intersections or merely standing by the roadside.

Drivers whose vehicles have broken down at night, such as with a flat tire or out of gasoline, and who attempt to fix the tire or wait by the car, are subject to being struck by oncoming vehicles, especially if the driver fails to leave his vehicle lights on.

Boaters who venture out on rivers or lakes at night and encounter some form of problem with their boat need some means of signalling to other nearby boaters or to persons on shore that they are in difficulty and require assistance.

These are but a few of the many examples of situations in which people require a small, portable source of bright flashing light to attract the attention of others, either to warn of some impending danger or to attract attention for the purpose of providing assistance. There are many diverse situations in which a device such as that of the present invention is of great help, even of dire necessity, particularly in a life threatening situation.

The device of the present invention should not be confused with a typical flashlight, which is intended to provide a high degree of illumination for a short distance for the purpose of providing the holder of the flashlight with sufficient illumination to see his way or perform some task. And although a typical flashlight can, in an emergency, function as a flasher to warn others of impending danger or the need for assistance, it is not intended for that type of use. One drawback of using a flashlight as a flasher is that the flashlight bulb is designed for continuous use, and constant energizing and deenergizing of the bulb to simulate flashing will quickly cause the lighting filament to burn out. In addition, in order to operate a flashlight as a flasher, it is necessary to continuously operate the on-off switch, which requires some form of manual dexterity by the user, thereby diverting his attention from other matters, such as changing the tire, or steering the boat. For these, and other reasons, flashlights simply are inadequate and unacceptable substitutes for a flasher.

Flashers per se are not new, and many can be found in the art and the market place. Typically, flashers fall into two categories, those having a bi-metallic element in an otherwise conventional filament bulb, which is flashed on and off by the bi-metallic element in response to deformation from heat; and those of the so-called "strobe" type in which solid state electronic circuitry controls the intermittent flashing of a strobe bulb capable of emitting light of enormous intensity for a very brief interval of time. A device of the first mentioned type is very inexpensive, but suffers from poor battery life because power is required both to intermittently heat the bi-metallic element and the filament in the bulb. The strobe light has the advantages of long battery life and intense light, even from a small battery, but devices of this type tend to be expensive due to the necessity for solid state circuitry and the physical construction and size of the package required to house the power supply, the electronic circuit boards and the strobe bulb. Thus, prior art devices of this type tend to be of a size that makes them difficult to hold in one hand or to be worn on the body. If they are designed for portability, they are typically difficult to mount in a fixed position on a suitable support. And they tend to be considerably more costly than the first type of flashers mentioned above, thereby making them non-competitive with that type of flasher.

The present invention seeks to provide a device of the character described which retains the advantages of known electronic flasher devices yet avoids the disadvantages and drawbacks thereof by providing certain unique features of design and construction hereinafter disclosed and claimed.

SUMMARY OF THE INVENTION

The present invention at least obviates if not eliminates the above described, as well as other, disadvantages and drawbacks of prior art electronic flasher devices by providing a device of this type which is extremely compact, highly portable and quite inexpensive, yet which is rugged in construction to meet the requirements of a variety of operating conditions, provides intense illumination which can be seen from all directions except the bottom, and has a long operating life during which it is virtually maintenance free. For example, some of the design criteria established for the device of the present invention are that it be able to operate for at least 2 hours on 2 fresh AA alkaline or AA lithium batteries at a minimum of 60 flashes or higher per minute, and then indicate a low battery condition by reduced flashing rate, erratic flashing and/or reduced brightness. The device will be weather proof and sufficiently rugged to withstand being dropped onto concrete from a height of 3 feet. It will withstand extended storage at extreme temperatures (like those to which it will be exposed in consumer usage such as on the exposed dashboard of a car in summer, where temperatures reach 160° F., or extreme cold (20° to below 0° F.), and it will operate reliably at −10° to 115° F., in conditions of extreme humidity, as well as rapid changes in temperature and humidity, and in rain or snow.

In its broadest aspects, the flasher device of the present invention comprises a housing having bi-directional planar dimensions and an axial dimension, the planar dimensions being substantially larger than the axial dimension to give the housing substantially greater planar extent than axial extent, the bi-directional dimensions being such that the housing also has a peripheral extent suitable for holding the housing within an average human hand. An illumination means is mounted within the housing in a position generally central with respect to the planar extent of the housing. There is a circuit means mounted in the housing for periodically and momentarily energizing the illumination means to cause the illumination means to flash periodically.

In some of its more limited aspects, the housing can have any of a number of peripheral configurations, such as triangular, the shape of the presently preferred embodiment, circular, oval, square, rectangular or any multi-sided configuration having more than 4 sides.

The housing has a rear body member and a complementary front body member, with means to removably latch the two together. The rear body member is provided with a pair of elongate walls arranged at an angle with respect to each other to divide the rear body member into a plurality of compartments, two outer battery compartments arranged at an angle with respect to each other, and an inner compartment in which the electronic circuit board, a reflector and the flash tube are mounted.

Having briefly described the general nature and construction of the present invention, it is a principal object thereof to provide a portable electronic flasher device which is sufficiently small and compact to fit comfortably in an average size adult human hand, or a pocket or which can be worn or mounted on a suitable support.

It is another object of the present invention to provide a portable flasher device which is very rugged in construction and substantially weather proof.

It is still another object of the present invention to provide a portable flasher device which can be made in a variety of peripheral configurations and yet retain the features of compactness and ease of use.

These and other objects and advantages of the present invention will become more apparent from an understanding of the following detailed description of a presently preferred embodiment of the invention, when considered in conjunction with the accompanying drawings.

DESCRIPTION OF THE DRAWINGS

FIG. 12 is a perspective view of the switch used in the flasher device.

FIG. 13 is an exploded view of the elements of the switch shown in FIG. 12.

DETAILED DESCRIPTION OF THE INVENTION

Figure 1:
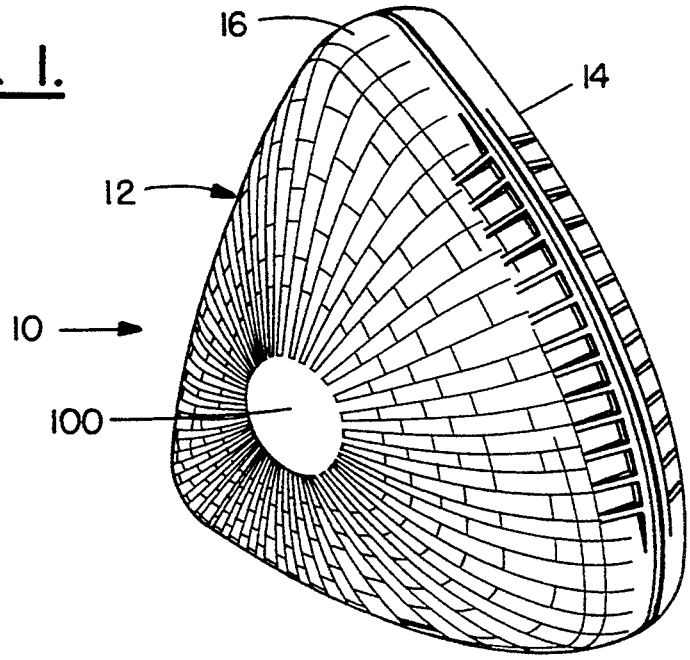
FIG. 1 is a perspective view of the presently preferred embodiment of the present invention.
Figure 2:
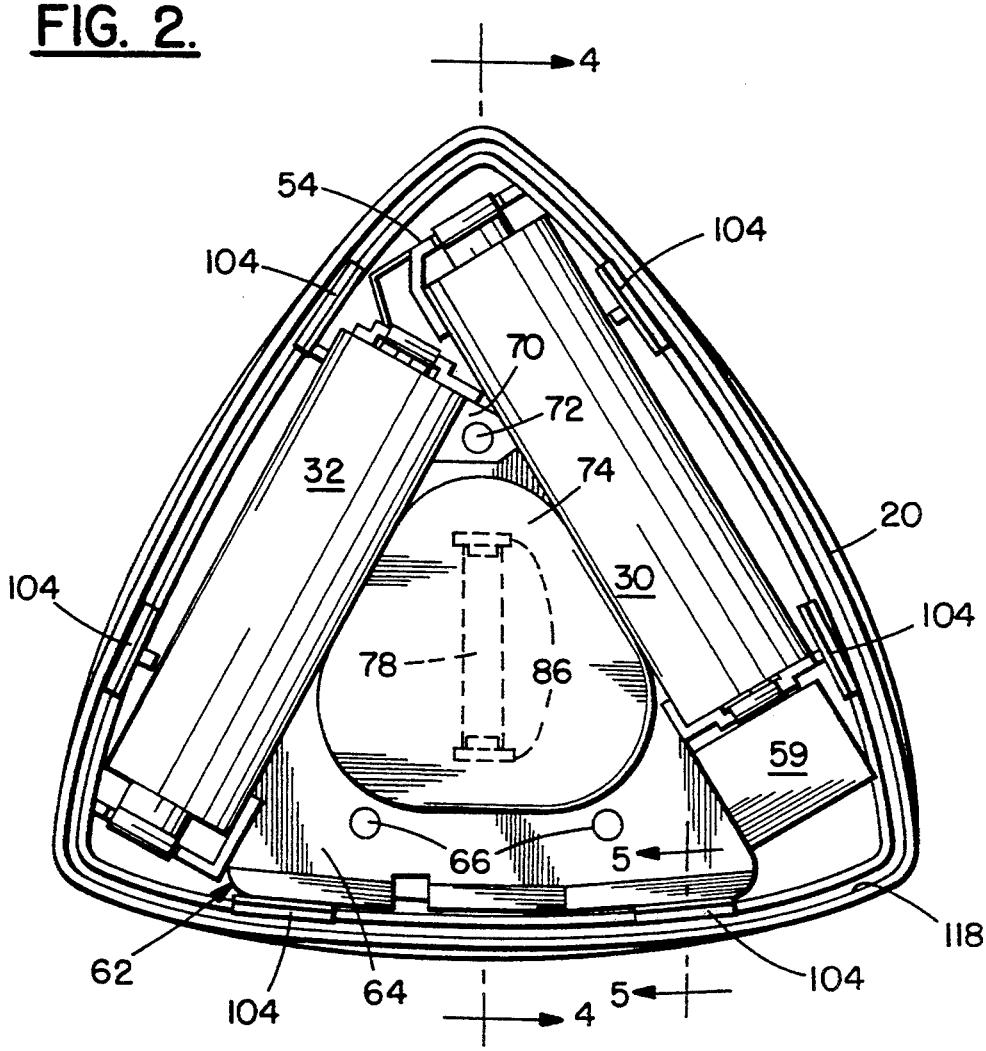
FIG. 2 is a plan view of the inside of the flasher device shown in FIG. 1 with the front cover removed.

Referring now to the drawings, and particularly to FIGS. 1 through 4 thereof, the electronic flasher device of the present invention is designated generally by the reference numeral 10, and is seen to comprise a housing generally designated by the reference numeral 12. The housing 12 comprises a rear body member 14 and a front body member 16, which are jointed together to form the housing 12.

The flasher unit in the embodiment shown in the drawings is designed for the new lithium AA batteries. Lithium batteries have an extraordinary shelf life, approximately ten years. They also have good service and storage characteristics. For instance, they can withstand temperature extremes of −40° F. to +160° F. This makes them ideal for emergency use devices such as the flash unit described herein.

Depending on the peripheral configuration of the housing 12 as discussed in the next paragraph, the housing 12 has various bi-directional planar dimensions which define the planar extend of the housing 12, and an axial dimension which defines the thickness of the housing. For example, the device illustrated in the drawings is generally of triangular configuration, notwithstanding that the side edges of the housing 12 have a slight curvature. Thus, the planar dimensions are those which define the length of the side edges of the triangle, or those which define the distance from the center of a side edge to the opposite intersection of the adjacent side edges. The axial dimension defines the distance between opposed walls of the rear and front body members 14 and 16, more fully described below, and thereby the thickness of the device 10.

It is deemed to be within the scope of the invention for the housing 12 to have configurations other than that shown in the drawings. For example, the housing could have a circular configuration, in which all bi-directional planar dimensions are diameters and therefore are equal; an oval configuration in which the bi-directional dimensions are different depending on whether they extend across the long short portions of the oval; a square configuration in which the bi-directional dimensions are either side edges or diagonals, but in either case are equal; a rectangular configuration in which even the side dimensions are different from each other and from the diagonal dimension; and finally any polygonal configuration having more than 4 sides in which various groups of planar dimensions will be different. These alternative configurations are believed to be sufficiently apparent as not to require separate illustrations in the drawings.

There are at least two distinctive features of the dimensional relationships of the device 10 which lend to the unique configuration of the device regardless of the actual peripheral configurations just described. The first is the relationship between the bi-directional planar dimensions and the axial dimension, and the second is the size of the peripheral extent of the device 10 as defined by the bi-directional planar dimensions. With regard to the first feature, it will be seen that, regardless of the specific configuration of the housing 12 as described in the preceding paragraph, the planar dimensions are substantially larger than the axial dimension, with the result that the housing has a substantially greater planar extent than the axial extent. In other words, the housing 12 is considerably broader across than it is thick.

Figure 6:
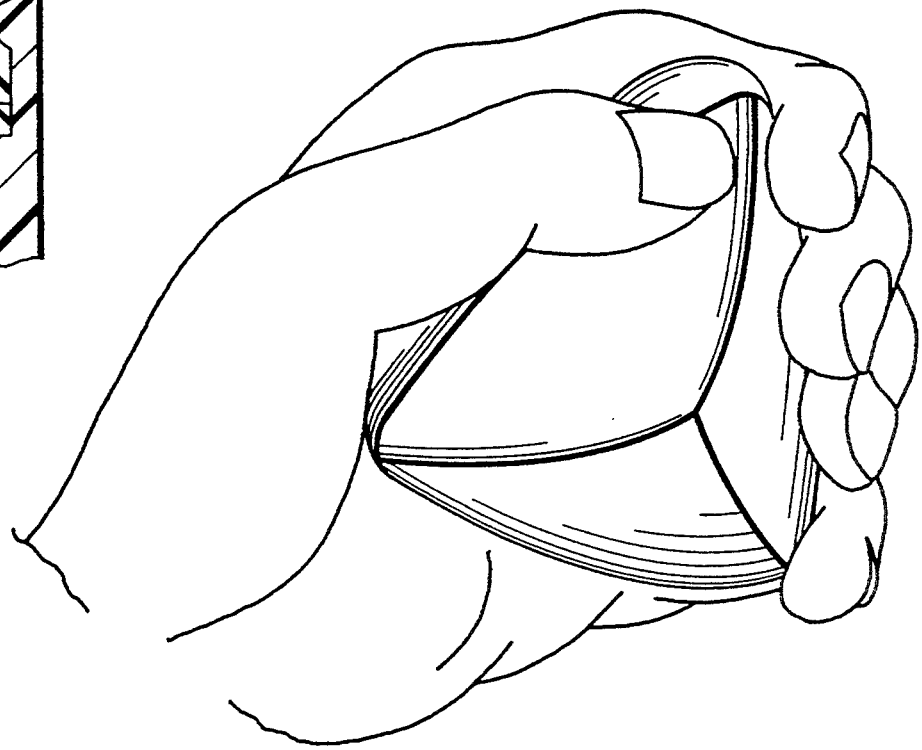
FIG. 6 is a perspective view of the device of the present invention being held in an average size adult human hand.

With regard to the second feature, it will be seen in FIG. 6 that the planar dimensions are selected to provide the housing 12 with a planar extent such that the housing 12 will fit easily and comfortably within the limits of an average adult human hand. In the case of the preferred embodiment illustrated in the drawings, the housing 12 is approximately 3 inches from any point across to the center of the opposite side edge, thus making it possible for an adult user having average size hands to hold the device 10 comfortably in the palm of his hand with his fingers and thumb conveniently embracing the side edges and a portion of the front body member 16. The importance of these configurational features will be more apparent from the description of the device set forth below.

Referring again to the aforementioned figures, it will be seen that the rear body member 12 has a substantially flat bottom wall 18 and an upstanding side wall 20 which extends around the entire periphery of the rear body member 14. A pair of elongate upstanding walls 22 and 24 are connected to or formed integrally with the bottom wall 18, the walls 22 and 24 being arranged at an angle so as to divide the interior of the rear body member 12 into a plurality of compartments.

There is a pair of outer compartments 26 and 28 which are adapted to receive a pair of conventional tubular batteries 30 and 32, typically the AA size, and an inner compartment 34 adapted to receive a printed circuit board 36. A pair of mounting posts 38 and 40 are also connected to or formed integrally with the bottom wall 18 and, in cooperation with the adjacent ends of the walls 22 and 24, tend to define the inner compartment 34 as being generally rectangular. The mounting posts 38 and 40, as well as the junction 42 of the walls 22 and 24, are provided with threaded openings to receive screws 44.

A plurality of upstanding tabs 46, 48 and 50 are connected to or formed integrally with the bottom wall 18, the tabs 46 and 50 being located at the divergent ends of the outer battery compartments 26 and 28, the tab 50 being located adjacent the juncture 42 of the walls 22 and 24. A plurality of battery contact terminals 52, 54 and 56 are mounted on the tabs 46, 48 and 50 respectively, the contact terminals 52 and 56 being electrically connected to the printed circuit board 36 in an appropriate manner to provide an electric circuit between the batteries 30 and 32, and the contact terminal 54 contacting the negative end of the battery 30 and the positive end of the battery 32 in order to close the circuit between the two batteries and the printed circuit board.

The printed circuit board 36 has a generally triangular configuration and rests on the top of the mounting posts 38 and 40 and the juncture 42 of the walls 22 and 24. One apex of the circuit board 36 is provided with a tab 58 which rests on the juncture 42 of the walls 22 and 24, and the tab 58 and the other apices are provided with apertures 59 which align with the threaded holes in the mounting posts 38 and 40 and the juncture 42 to accommodate the screws 44 as hereinafter described. A suitable on-off switch 61 is connected to the printed circuit board by means of the mounting and contact tabs 63 which fit into slots 65 in the circuit board 36, the switch 61 having an actuating button 67 which projects through an opening 69 in the bottom wall 18 of the body member 12. A capacitor 69 is suitably connected to the circuit board 36 for storing electrical energy from the batteries 30 and 32 and periodically dumping that energy into the flash tube (described below), in a manner well known in the art.

Figure 3:
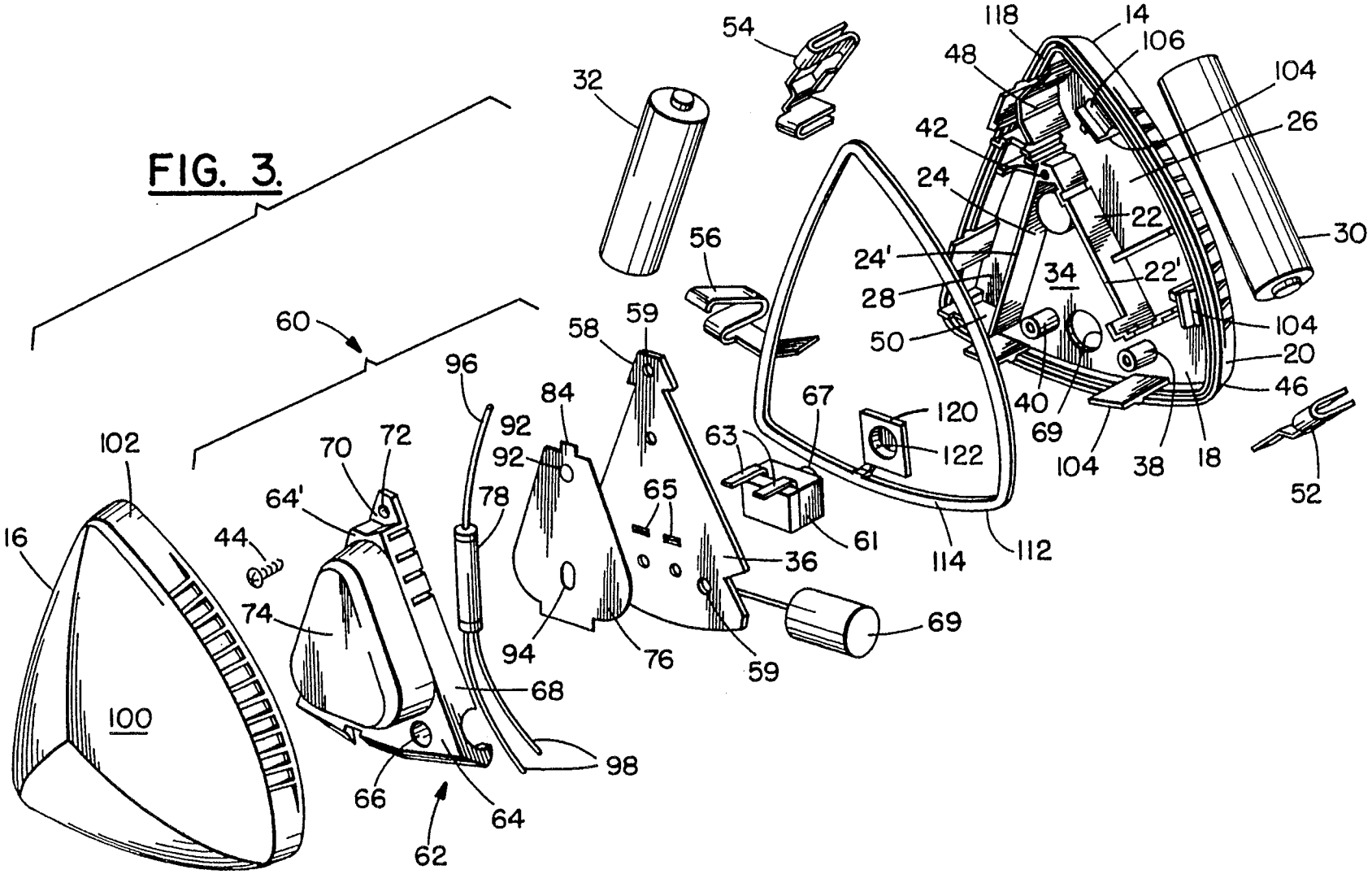
FIG. 3 is an exploded view of the flasher device shown in FIG. 1.

An illuminating means, generally designated by the reference numeral 60 in FIG. 3, comprises a flash tube cover which is a housing, generally designated by the reference numeral 62, having generally the same triangular configuration as the circuit board 36. The flash tube cover housing 62 has a flat wall portion 64 which extends between the divergent ends of the walls 22 and 24 and also extends toward the juncture 42 for only a short distance, but at least sufficient to have the flat wall portion 64 overlie the mounting posts 38 and 40. Another portion 64' of the flat wall portion 64 is disposed at the opposite apex of the housing 62. The flat wall portion has a pair of apertures 66 which overlie the threaded holes in the mounting posts and are aligned therewith. The housing 62 also has a depending wall 68 which extends around the periphery of the housing 62, the two sides of which are positioned to rest on the upper edges 22' and 24' of the walls 22 and 24, and a third side of which rests on the corresponding edge of the circuit board 36 adjacent to the mounting posts 38 and 40. The depending wall 68 is provided with a small laterally projecting flange 70 which rests on the tab 58 of the circuit board 36, the flange 70 having an aperture 72 which overlies the aperture 59 in the circuit board tab 58 and is aligned therewith and with the threaded hole in the juncture 42. Thus, by this arrangement, when the screws 44 are inserted into the two apertures 66 and the aperture 72 of the cover 62, the apertures 59 of the circuit board 36, and into the threaded holes on the mounting posts 38 and 40 and the juncture 42, the flash tube cover 62 and the circuit board 36 are both securely fixed to the rear body member 18 of the housing 12.

Figure 4:
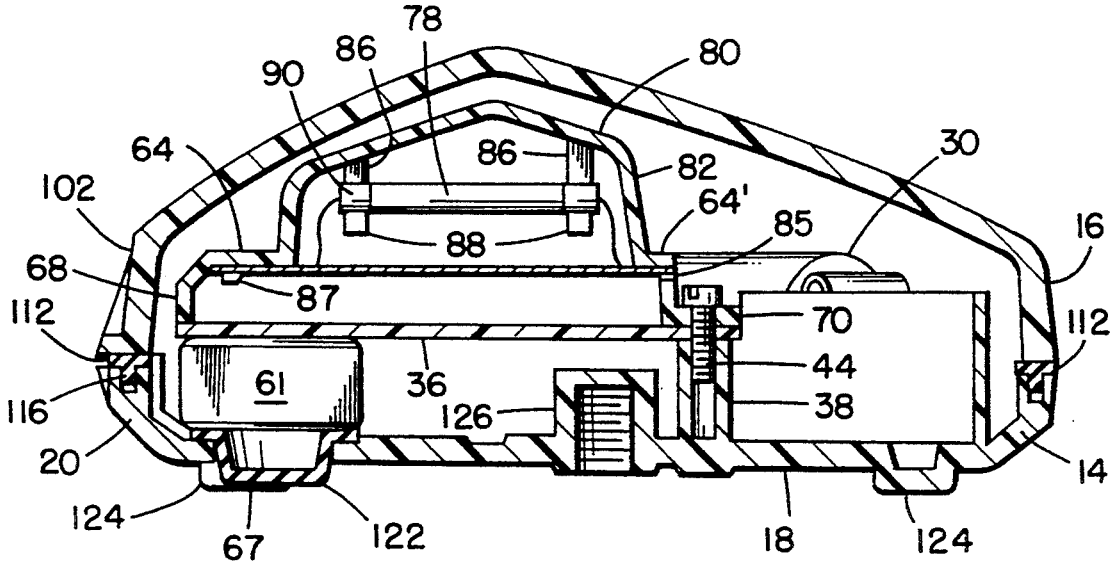
FIG. 4 is a sectional view taken on the line 4—4 of FIG. 2.

The flash tube cover housing 62 further includes an upwardly projecting bulbous portion 74 which is formed of a clear plastic material and defines an enclosure for a reflector 76 and a flash tube 78. As best seen in FIGS. 3 and 4, the bulbous portion 74 has a generally domed top wall 80 and a depending side wall 82, which extends around the periphery of the bulbous portion 74, which itself has a generally triangular configuration corresponding to that of the flash tube cover 62, although somewhat smaller. The reflector 76 is provided with a short tab 84 which is received within a slot 85 (see FIG. 4) formed in the depending side wall 68 of the flash tube cover housing 62, and an elongate tab 86 which is suitably secured to the undersurface of the flat wall 64 by means of the resilient latching finger 87. Thus, the reflector 76 is readily removable from the housing 62.

As best seen in FIG. 4, a pair of flash tube brackets 86 as suitably secured to the undersurface of the domed upper wall 80, the brackets 86 each having a pair of resilient fingers 88 which are spaced apart to permit insertion of the metallic ends 90 of the flash tube 78 and yet grip the metallic ends 90 with sufficient force to hold the flash tube 78 in place. The reflector 76 is provided with apertures 92 and 94 through which the leads 96 and 98 from the flash tube 78 extend respectively for suitable connection to the circuit board 36.

Figure 5:
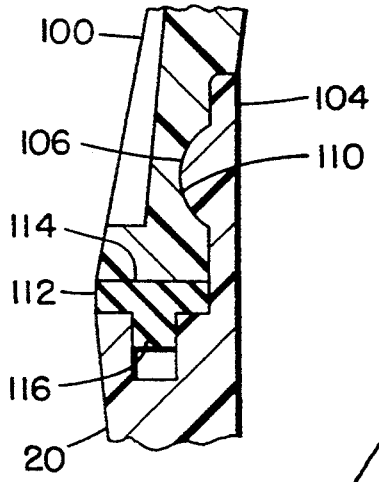
FIG. 5 is a fragmentary sectional view, drawn to an enlarged scale, taken on the line 5—5 of FIG. 2.
Figure 7:
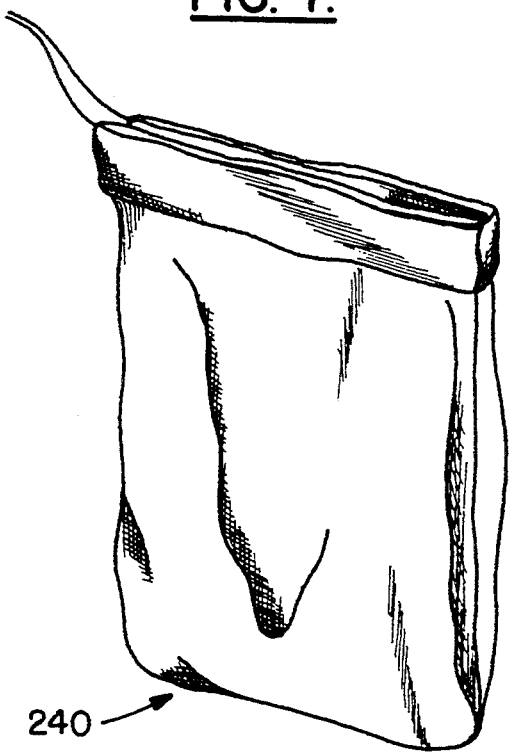
FIG. 7 is a perspective view of a carrying case within which the flasher device and its accessories can be held.

The front body member 16 is preferably fabricated entirely of clear plastic and includes a top wall 100 which is somewhat domed, as best seen in FIG. 4, in a manner corresponding to the domed configuration of the top wall 80 of the bulbous portion 74 of the housing 62, and further includes a depending side wall 102 which extends entirely around the periphery of the front body member and is complementary to the upstanding side wall 20 on the rear wall member 16. As best seen in FIGS. 5, 6 and 7, the front body member 16 is secured to the rear body member 14 by means of a pair of resilient latching tabs 104, which project upwardly from the side wall 20 of the rear body member 14. As best seen in FIG. 3, there is a pair of latching tabs 104 on all three sides of the rear body member 14. The latching tabs 104 are provided with a laterally extending bead 106 about half way up the length of the latching tab 104. The depending side wall 100 on the front body member 16 is provided with a pair of recesses 108 on all three sides of the body member, each recess 108 having a laterally extending detent 110 adapted to receive the bead 106 of one pair of latching tabs 104 when the front body member 16 is pressed onto the rear body member 14, as best seen in FIG. 5.

A sealing gasket 112 is disposed on the upper edge of the upstanding wall 20 of the rear body member 14, the sealing gasket having a flat upper surface 114 and a depending flange 116 which is received within a groove 118 (FIG. 2) extending around the periphery of the rear body member 14. The sealing gasket 112 also includes a rectangular membrane 120 having a circular depression 122 formed therein which surrounds the actuating button 67 of the switch 61, thereby sealing the switch 61 from outside atmosphere. The sealing gasket 112 effectively seals the entire inside of the flasher device 10 from outside atmosphere when the two body members 14 and 16 are snapped together as seen in FIG. 5.

Optionally, the bottom wall 18 of the rear body member 14 may be provided with a pair of loops 124 for receiving a short length of a suitable elastic material by which the flasher device 10 can be secured to the wrist or arm of the person using the flasher device 10, thereby permitting the person to walk, steer the boat, perform some activity, etc., without having to hold the flasher device 10 in his pocket or find a suitable support for it. Alternatively, the bottom wall 18 of the rear body member 14 is provided with a raised boss 126 which is internally threaded and opening toward the outside of the rear body member 14, the threads in the boss corresponding to those on a standard photographic tripod, thereby permitting the flasher device 10 to be mounted on any of a variety of readily available floor or miniature table top tripods readily available.

Figure 8A:
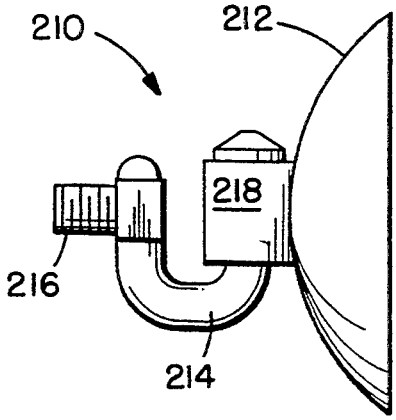
FIGS. 8*a* and 8*b* are side and top views respectively, of a suction cup accessory used with the flasher device.
Figure 8B:
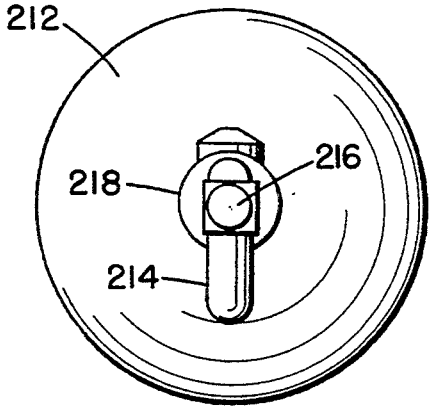

In another embodiment of the invention, the flasher device can be provided with several accessories, such as those shown in FIGS. 8*a*, 8*b*, 9*a*, 9*b*, 10*a*, 10*b*, and 11 to form a flasher kit. FIGS. 8*a* & 8*b* show a suction cup accessory 210 including a suction cup 212 supported by threaded bracket 214 having threaded portion 216 for attaching the bracket to the flasher device 200. The suction cup is mounted on collar 218 which is pivotally mounted on bracket 214. This suction design very elegantly and economically allows correct angling of the unit.

Figure 9A:
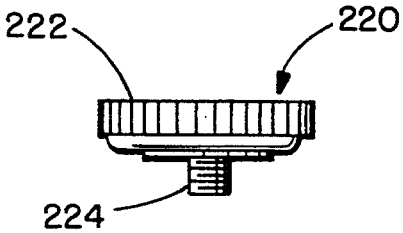
FIGS. 9*a* and 9*b* are side and top views, respectively, of a magnetic accessory used with the flasher device.
Figure 9B:
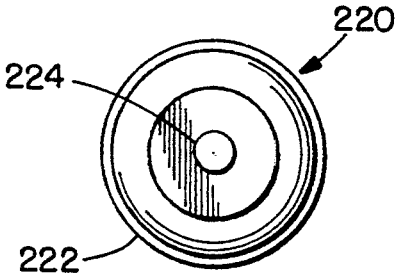
Figure 10A:
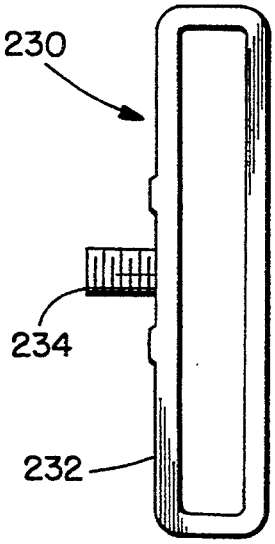
FIGS. 10*a* and 10*b* are side and top views, respectively, of a belt carrier accessory used with the flasher device.
Figure 10B:
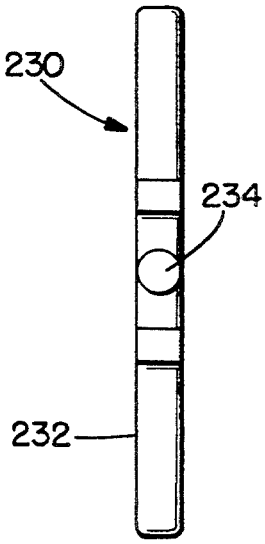
Figure 11:
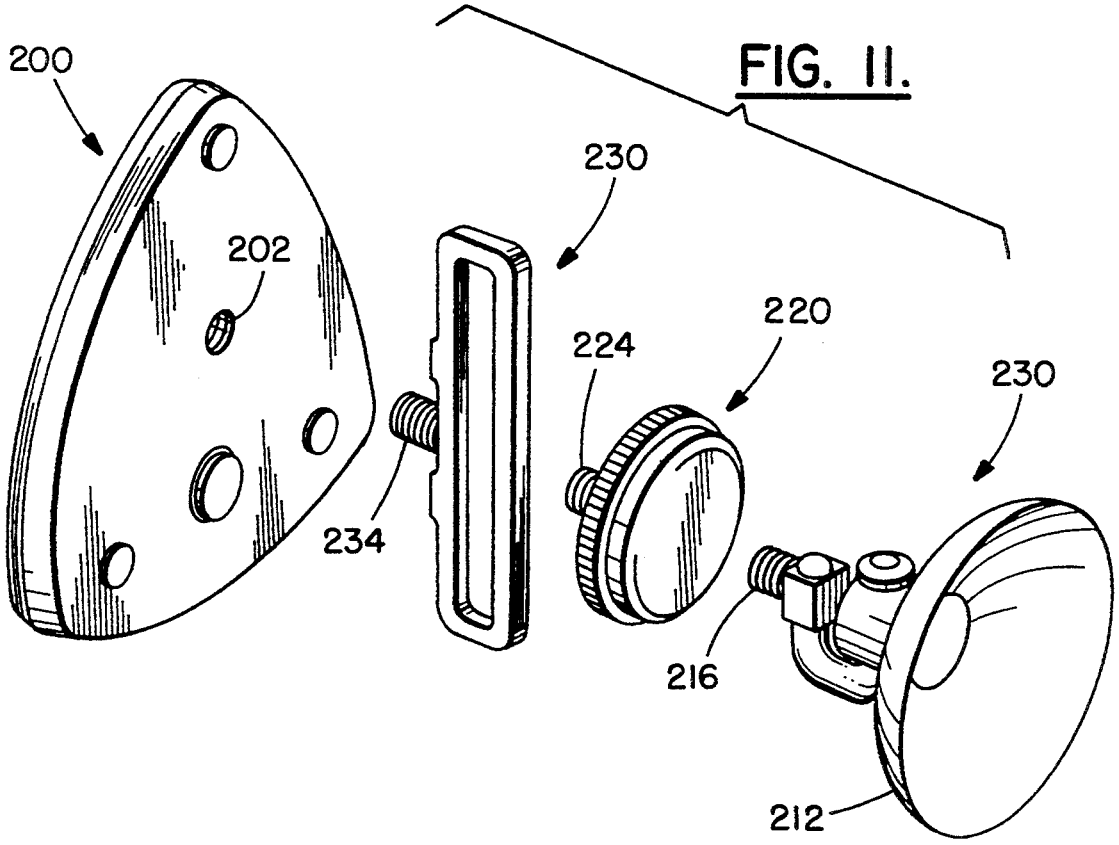
FIG. 11 is an exploded view of the three accessories described in FIGS. 8*a*, 8*b*, 9*a*, 9*b*, 10*a*, and 10*b* aligned with the threaded hole in the bottom of the flasher device as each would be screwed into the threaded hole.

FIGS. 9*a* & 9*b* show magnetic accessory 220 with magnet 222 having threaded portion 224 for attaching the magnetic device to the flasher device. FIGS. 10*a* & 10*b* show belt carrier 230 with belt loop 232 having threaded portion 234 for attaching belt carrier 230 to the flasher device. FIG. 11 shows each of these accessories with flasher device 200 the combination of these making up a kit that can be sold together and assembled in various combinations depending upon the environment in which the flasher device is used. The flasher device and accessories can be kept together in pouch 240, or other suitable container.

FIGS. 12 and 13 show the flasher's on-off switch in more detail. Housing 301 contains all other parts of the switch. At the center is a cylindrical hole 304 with 8 parallel slots (situated between "Guides") for running 4 slide blocks 306 of button 367 and also rotor 368 and restraining then from moving in the axial direction. The end face of each guide is a slant surface having a cam-effect. Housing 301 includes cover 303 which slightly compresses spring 308 when assembled. Button 367 is a cylindrical cup with the open end designed in saw-teeth shape to serve as a cam for rotor 368. The 4 external slide-blocks of the rotor run inside the slots of housing 301.

Rotor 368 is cylindrical and is assembled inside button 367. There is a saw-tooth cam situated in the opposite direction of that of button 367 which serves as a follower to the cam of button 367. It firmly holds the rotor contact 310 and rotates with it during operation. There are also 4 external slide-blocks running inside the slots of housing 301. The positions of the 4 external slide-blocks are designed such that when they are engaged in the slots of the housing, the saw-teeth are slightly offset to one side with respect to the saw-teeth of the button. As long as the rotor is slotted in the housing, there is always a tangential force provided by the button on the rotor with the result that the button always tends to turn the rotor. The end face of each slide-block is a slant surface slanting in the same direction as the end face of each guide of the Housing. Contact plate 312 has two identical pieces for connection to the external electrical circuit. Rotor contact 310, held firmly by rotor 368, is used to "bridge" the two pieces of contact plates 312 by contacting both of them in the on state. While in the off state, rotor contact 310 turns to a position at 45° to disconnect the two contact plates.

Spring 308 is a compression spring which provides an axial force on all moving parts, i.e., rotor contact 310, rotor 368 and button 367.

The on-off switch operates as follows:

1. In the off state, the rotor contact is at 45° to the contact plates, but is not in contact with both of the contact plates. In the partially depressed state, the rotor is lifted up by the button through the contact of the saw-teeth of the two parts. It should be noted that, as already described, contact of the two cams is made at one side of each tooth. The rotor receives a "turning force" from the button, but since it is still slotted, it cannot turn yet. In the fully depressed state, the rotor is lifted to the highest level and the slide blocks are now disengaged from the slots. The rotor is then free to turn to a new position. In the on state, upon releasing the button from the fully depressed level, the slide blocks of the rotor, which are now facing head-on with the guides of the housing, make the rotor rotate further because of the cam-effect on both of these end faces. The rotor then continues this rotation until its 4 slide blocks slip into the set of slots in the housing. Since there are 8 slots in the housing, the rotor has turned 45°. The rotor contact is now in contact with both contact plates and the switch has therefore changed to the on state.

Figure 14:
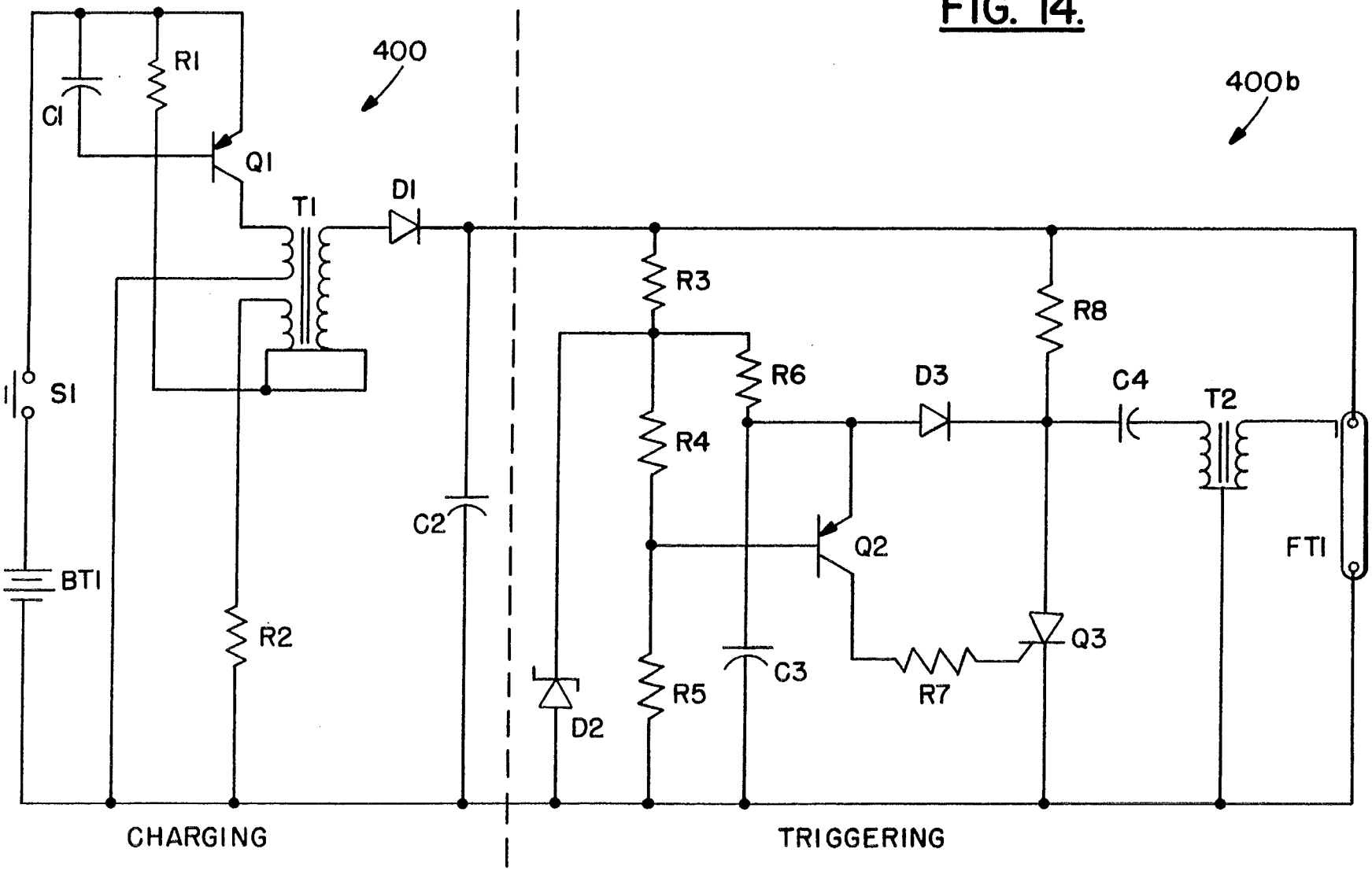
FIG. 14 is a schematic illustration of the electrical circuitry of the flasher device.

FIG. 14 shows the flash circuitry. The circuitry illustrated in FIG. 14 is divided into two parts. The first part is a DC/DC converter 400*a* that operates to charge the capacitor C2 and therefore store electrical energy upon C2. The PNP transistor Q1 and the transformer T1 combine to work as an oscillator, and their output is chopped by the diode D1. Thus a half-wave rectification is produced to charge the capacitor C2 exponentially.

The second part of the circuitry is a triggering circuit 400*b* that operates to trigger the firing of flashtube 78 by delivering the stored energy in the capacitor C2 to the flashtube when C2 has been charged to an appropriate level. This operation differs from a conventional flash unit in that the firing of the flash is cycled automatically. That is, when C2 is charged to the required level, the unit is triggered and the flash is fired. C2 is therefore quickly discharged. The charging process then immediately restarts and the charging and firing process repeats continuously until the battery becomes too weak to charge C2 to the required level.

The level at which the flash unit is fired is determined by the voltage level appearing on capacitor C3, which is also exponentially charged through the resistors R3 and R6. In the initial stage of charging, the voltages of C2 and hence of C3 are low such that the potential difference across the emitter and base of the PNP transistor Q2 is also low. Thus, Q2 is in the off-state. No electrical current is delivered to the gate of the SCR Q3 and the firing of the flash unit is disabled. A triggering capacitor C4 is also exponentially charged while C2 and C3 are being charged. If Q3 is turned on, C4 will be immediately discharged such that a LC oscillation is produced between C4 and the trigger coil T2. A very high voltage oscillation is thus developed in the secondary coil of T2 and flashtube 78 is triggered to fire.

Upon a certain level of the charged-up voltage of C3, the potential difference across the emitter and base of the transistor Q2 becomes sufficiently large such that Q2 is turned on. Under this condition, current is delivered to the gate of Q3 and the latter is turned on for the firing of the flash. Upon the firing and the discharge of the capacitors C2, C3, and C4, Q2 and Q3 are again turned off until the next charged-up voltage level of C3 is reached.

R5 can be adjusted to vary the frequency of firing. The purpose of the diode D3 is mainly to discharge the capacitor C3 through Q3 as soon as Q3 is turned on for the firing of the flash. The zener diode D2 sets a reference potential at the node connected to resistors R3, R4 and R6.

It should be understood that the foregoing description that the present invention has resulted in the development of a highly compact, ergonomically efficient and user friendly electronic flasher device which achieves the objective set forth hereabove. It will be understood that variation and modifications to the design and configuration of parts, as well as to the details of construction and assembly which are within the knowledge of those skilled in the art, may be made without departing from the spirit and scope of the invention, the scope of which shall be determined and limited only by the appended claims.

What is claimed is:

1. A portable flasher device of a size adapted to be hand held, carried in a pocket, worn on a wrist or arm, or mounted on a convenient surface, said device comprising:

A. a housing having front and rear body members joined together, said housing having bi-directional planar dimensions and an axial dimension, said planar dimensions being substantially larger than said axial dimension to give said housing substantially greater planar extent than axial extent whereby said housing is substantially larger across its planar extent than it is thick in axial extent, said bi-directional planar dimensions being such as to define a peripheral extent and axial thickness of said housing suitable for holding said housing within an average adult human hand with said rear body member resting on the palm the hand and the fingertips and thumb thereof grasping said front body member, B. illumination means mounted within said housing in a position generally centrally with respect to said planar extent, and C. circuit means mounted in said housing for periodically and momentarily energizing said illumination means to cause said illumination means to periodically flash, whereby said flasher device can be conveniently carried in the palm of the hand of a user while walking or performing some task.

2. A flasher device as set forth in claim 1 wherein said peripheral extent has a generally triangular configuration.

3. A flasher device as set forth in claim 1 wherein said peripheral extent has a generally circular configuration.

4. A flasher device as set forth in claim 1 wherein said peripheral extent has a generally square configuration.

5. A flasher device as set forth in claim 1 wherein said peripheral extent has a generally rectangular configuration.

6. A flasher device as set forth in claim 1 wherein said peripheral extent has a multi-sided configuration in excess of four sides.

7. A flasher device as set forth in claim 1 wherein said housing comprises:

A. a rear body member having said substantially flat bottom wall and an upstanding peripheral side wall surrounding said peripheral extent, said illumination means, said battery means and circuit means all being mounted on said rear body member, B. said front body member having a generally domed top wall and a depending peripheral side wall surrounding said peripheral extent and having the same configuration as the peripheral configuration of said peripheral side wall of said rear body member, and C. cooperating latching means on said peripheral side walls of said rear body member and said front body member to connect said body members together to form said housing.

8. A device as set forth in claim 7 wherein said rear body member includes an outwardly opening recess therein, said recess being threaded to match the threaded stud on standard photographic tripods, or other type of accessory.

9. A device as set forth in claim 7 wherein said rear body member includes at least one loop on said rear body member for receiving a piece of elastic material thereby permitting said device to be worn on the wrist or arm of a user.

10. A flasher device as set forth in claim 7 wherein said housing further includes a sealing gasket disposed between said peripheral side walls of said rear body member and said front body member to seal the interior of said housing against atmosphere when said rear body member and said front body member are connected together.

11. A device as set forth in claim 10 wherein said rear body member includes:

A. a pair of elongate upstanding walls disposed on said flat bottom wall at an angle to each other, said upstanding walls thereby defining, with adjacent portions of said peripheral side wall, a pair of elongate spaces in said rear body member disposed at substantially the same angle to each other as that of said side walls, said upstanding walls also defining therebetween another space having a generally triangular configuration, and B. a plurality of upstanding tabs disposed on said flat bottom wall adjacent opposite ends of said elongate spaces.

12. A device as set forth in claim 11 wherein said circuit means comprises:

A. a printed circuit board having a generally triangular configuration corresponding approximately to the triangular configuration of said space defined between said upstanding walls, said circuit board being disposed within said triangular space, and B. electric contact means mounted on said upstanding tabs for contacting opposite ends of batteries received in said elongate spaces, the contact means disposed at the divergent ends of said elongate spaces also functioning to receive wires for completing a circuit from the batteries to said circuit board.

13. A flasher device as set forth in claim 12 wherein

A. said circuit means also includes a switch means having an actuator which projects through an aperture in said rear body member for manually turning said flasher device on and off, and B. said sealing gasket includes a membrane extending inwardly from the peripheral portion thereof to normally cover said aperture in said rear body member, said membrane being stretched through said aperture when said switch means actuator is in place in said aperture so that said membrane also seals the interior of said housing from atmosphere when said rear and front body members are connected together.

14. A device as set forth in claim 12 wherein said illuminating means comprises:

A. a generally triangular flash tube housing mounted on said rear body member and having a peripheral extent sufficient to overlie said printed circuit board, said housing having an upwardly protruding bulbous portion which is also of generally triangular configuration but smaller in extent than the triangular configuration of said housing, B. reflector means secured to said flash tube housing in overlying relationship with said printed circuit board adjacent to the lower end of said upwardly protruding bulbous portion, C. an elongate flash tube disposed in said upwardly protruding bulbous portion, and D. bracket means in said upwardly protruding bulbous portion for holding said elongate flash tube in spaced relation with said reflector.

15. A flasher device as set forth in claim 14 wherein

A. said rear body member includes a pair of upstanding bosses adjacent the divergent ends of said elongate upstanding walls, said bosses including threaded bores therein, the juncture of said elongate upstanding walls also having a threaded bore therein, and B. said flash tube housing has a depending side wall extending around the periphery thereof, two sides of which rest on the upper edges of said elongate upstanding walls, said flash tube housing being secured to said rear body member by screws which pass therethrough and into said threaded bores.

16. A flasher device as set forth in claim 15 wherein said circuit board rests on said bosses and said juncture of said elongate upstanding walls and is secured to said rear body member by said screws passing through apertures in said circuit board.

17. A flasher device as set forth in claim 12 wherein said reflector means comprises a generally flat reflector plate having a generally triangular configuration corresponding to the triangular configuration of said upwardly protruding bulbous portion of said flash tube housing and is removably secured to the underside of said flash tube housing adjacent to said bulbous portion.

18. A portable flasher kit comprising:

A. a portable flasher device of a size adapted to be hand held carried in a pocket, worn on the wrist or arm, or mounted a convenient surface, said flasher device having a means for mounting accessory devices thereto:

B. one or more accessory devices each having an attachment means which corresponds to said accessory mounting means on said flasher device whereby each of said accessory device can be mounted to said flasher device whereby the flasher device may be used alone or, alternatively, in combination with one of said one or more accessory devices included in said kit by attaching the accessory device to the flasher device.

19. A flasher kit as set forth in claim 18 wherein said accessory choices include a suction means.

20. A flasher kit as set forth in claim 18 wherein said accessory devices include a magnet means.

21. A flasher kit as set forth in claim 18 wherein said accessory devices include a belt carrier means.

22. A flasher kit as set forth in claim 18 further including a container adapted to keep all devices in the kit together.

23. A flash unit for repetitively activating a flash tube in an automatic manner, comprising:

a DC power source for charging a first capacitance;

an electronic switch means coupled to said first capacitance and a flashtube; and electronic control means having an output coupled to a control terminal of said electronic switch means for periodically causing said electronic switch means to close, thereby discharging said first capacitance and firing said flashtube; wherein said electronic control means includes a second capacitance coupled to a control input thereof, said second capacitance being coupled to said DC power source for being charged in parallel with said first capacitance, and wherein said electronic control means is responsive to said second capacitance charging to a predetermined level for activating said output of said electronic control means for causing said electronic switch means to close, thereby discharging both said first and said second capacitances.

24. A circuit for periodically generating a flash of light, said circuit having first and second nodes for coupling across a power source, third and fourth nodes for coupling across an illumination source, and a fifth node for coupling to a control terminal of said illumination source, comprising:

a first capacitance having first and second terminals coupled to said first and second nodes, respectively, and to said third and fourth nodes, respectively;

a second capacitance having a first terminal coupled through a resistance to said first node and a second terminal coupled to said second and fourth nodes, said first terminal of said second capacitance further being coupled to said fifth node through a third capacitance and through an inductance; and switching means coupled between said second and fourth nodes and said first terminal of said second capacitance, said switching means being responsive to a magnitude of a voltage potential appearing at said first terminal of said second capacitance for discharging said second capacitance and said third capacitance and causing said control terminal of said illumination source to initiate a current flow through said illumination source for discharging said first capacitance through said illumination source.

25. A circuit as set forth in claim 24, wherein said switching means is comprised of a solid state switch having a first terminal coupled between said first terminal of said second capacitance and a first terminal of said third capacitance, a second terminal coupled to said second and fourth nodes, and a switch control terminal coupled to a collector terminal of a transistor, said transistor having an emitter terminal coupled to said first terminal of said second capacitance and a base terminal coupled to a reference potential.

26. A circuit as set forth in claim 25, wherein said first terminal of said second capacitance is coupled to said first terminal of said third capacitance through a diode.

27. A circuit as set forth in claim 24, wherein said third capacitance has a first node coupled to said first node of said second capacitance, and wherein said inductance is comprised of a transformer having a primary winding coupled to a second terminal of said third capacitance and a secondary winding coupled to said fifth node.

* * * * *